United States Patent [19]

Ray

[11] Patent Number: 4,844,527

[45] Date of Patent: Jul. 4, 1989

[54] BALL PRACTICE AID

[76] Inventor: Lynn L. Ray, P.O. Box 3464, San Diego, Calif. 92103

[21] Appl. No.: 190,909

[22] Filed: May 6, 1988

[51] Int. Cl.[4] ..... B65F 3/00; B60P 3/00

[52] U.S. Cl. ..... 294/19.2; 414/440

[58] Field of Search ..... 294/19.2, 19.1; 273/32 F, 162 E, 162 F; 414/439, 440; 280/47.34, 47.35, 47.36; 248/129, 130, 132; 56/328 R

[56] References Cited

U.S. PATENT DOCUMENTS

| | | | |
|---|---|---|---|
| 2,484,437 | 10/1949 | Wells | 55/17 |
| 2,510,886 | 6/1950 | Morrison | 56/400.14 |
| 3,010,523 | 11/1961 | Gifford | 171/63 |
| 3,593,868 | 1/1971 | Folz | 414/440 |
| 3,717,371 | 2/1973 | Halone | 294/19 A |
| 3,902,749 | 9/1975 | Falitz | 294/19.2 |
| 4,077,533 | 3/1978 | Meyer | 214/356 |
| 4,252,490 | 2/1981 | Keller | 414/434 |
| 4,310,189 | 1/1982 | Nihra | 294/19.2 |
| 4,318,654 | 7/1980 | Lee | 414/440 |

*Primary Examiner*—James B. Marbert

*Attorney, Agent, or Firm*—Charmasson & Holz

[57] ABSTRACT

A multipurpose ball collector, ball storage and ball dispenser uses a wheel driven rotating shaft and fixed projections to positively collect balls, a wire cage to store balls and a folding handle with a folding cage door to conveniently allow withdrawing of the balls during practice. The folding handles are pivoted and attach to each other during collection to provide structural integrity. For dispensing, the handles and attached to the cage to form a structure which lifts the cage to within easy reach for the practicing player. Collection arms can also be provided to assist in ball collection or carrying the cage to a storage location.

10 Claims, 2 Drawing Sheets

BALL PRACTICE AID

FIELD OF THE INVENTION

This invention relates to amusement devices and games, more specifically to tennis ball collectors and practice aids.

BACKGROUND OF THE INVENTION

Practice for the game of tennis is necessary to develop the skills required. However the game requires at least two players and a practicing player may not want or be able to join another player for practice. Practicing alone on a regulation court can be accomplished, but one must be able to store a large number of tennis balls and be able to retrieve these balls or the practice primarily turns into an exercise in obtaining and retrieving tennis balls.

Retrieving tennis balls is an especially tedious, time consuming and unproductive task for a student or teacher or practicing player. One alternative is not to practice in a regulation tennis court, but to practice against a wall. This is not satisfactory to many players as it changes the character of the play. Mechanical serving devices are also available, but again reloading the device and collection of balls are a time consuming process. Other alternatives on a tennis court are to employ various practice aids, including types of ball sweeping/collection and ball storage and dispensing devices.

The primary objectives for a practice aid are (1) the practice aid must have a high capacity for the storage of tennis balls, (2) be conveniently within reach for dispensing balls and (3) be able to quickly collect balls laying at random on the court. Practice aid should be small so that it will not interfere with the practice and not overly obstruct the court. It should also be light weight, rugged in construction, pleasing in appearance and low in cost. When the practice aid is deployed in each of the three modes (collection, storage and dispensing), a minimum of effort to convert from one mode to another mode is also desirable.

Most of the current practice aids may do one of these objectives well, but others poorly or not at all. Ball hoppers conveniently provide access to dispense balls during practice, but many do not allow storage (covered) or transport. Others provide storage and access, but do not retrieve balls.

Ball storage devices also tends to be separate, typically in the can in which purchased. Transport to and from the storage location requires lifting. Larger storage devices accommodate many balls but are difficult to lift and transport.

Ball retrievers tend to be complex and cumbersome, limiting transport, access and use. Examples of ball collectors which do not function in the other modes and do not satisfy the other practice objectives include U.S. Pat. Nos. 2,484,437; 4,318,654; and 3,717,371. All of these devices only collect balls and all require separate hinged/rotating and/or fixed fingers/projections to lift and/or remove balls for placement into a receptacle. Many of these devices also tend to get caught by nets and fencing. Since these locations are likely places for balls to come to rest, this can be a major problem.

Prior art which attempts to accomplish all three of the primary objectives tend to be even more complex and cumbersome to lift, transport and use. U.S. Pat. No. 4,252,490 uses a spring loaded trapping mechanism, a non rotating ball engaging surface mounted to a jointed frame which allows multiple positions, wheels and a handle. The handle also serves as one of the supports when the device is used to dispense balls, but fold out legs are also required. The cage is also separate from the structure which supports these folding, multiposition elements. In addition, the spring mechanism must be periodically actuated, i.e: the process is a batch type for each ball or group of balls, rather than a continuous process.

In another approach to achieving a multimode practice aid, U.S. Pat. No. 4,077,533 uses a rotating drum, belt driven by traction wheels and axle, removable extension members to support the device in the dispensing position, a removable ball receptacle, a frame, a means to adjust the frame, an arcuate ball guide, and handle. Handle can be folded out of the way of the player during the dispensing mode and a ball guide with wheels can be used for partial support in the dispensing mode.

These prior multi-mode approaches have many limitations. These are primarily related to the multiplicity of elements required to accomplish the three operating modes, creating added cost, weight and space. This multiplicity of elements, weight and space particularly detract from the storage and dispensing modes. In addition, they also tend to get caught by nets and fencing located within the court in the collecting mode of operation.

None of the prior art cited incorporates positive collection (balls retained in a container with covered openings or openings smaller than the ball diameter) to allow immediate transport and storage without the use of additional movable elements in addition to traction wheels and an axle. None allows conversion to a dispensing mode without additional structure. All also tend to get caught when in contact with nets or fences when in the collecting mode.

SUMMARY OF THE INVENTION

The principal and secondary objects of the invention are:

To provide a practice aid capable of collecting, storing and dispensing balls;

To provide a practice aid which, when in the collection mode, will quickly gather and positively retain the collected balls without the use of additional movable structure;

To provide an aid which, when in the collection mode, does not get caught when in contact with nets or fences;

To provide a convenient handle for guiding the practice aid in the collection mode which also serves as the support during the dispensing mode and a means for lifting in the storage mode; and To provide a large but light weight storage bin which can be easily lifted for transport and storage.

These and other objects are achieved by a wire cage on two wheels connected by a rotating axle. The cage has an opening near the ground with optional projections over the opening to assist ball capture. The rotating axis is placed adjacent to an opening and projections of the wire cage, which when rotating axle is in contact with a tennis ball, lifts and rolls the ball against the cage opening and into the interior of the cage. The wire cage is steered by manual direction of two handles which project towards the rear, which fold and become supports for the cage when collection of balls is complete and dispensing mode is desired. The cage also includes a dispensing port covered by a latched door which folds out of the way of the practicing player. Ball entry guides can be added to reduce collection time and prevent the device from getting caught in the nets or fencing.

DESCRIPTION OF THE PREFERRED EMBODIMENT

Figure 1:
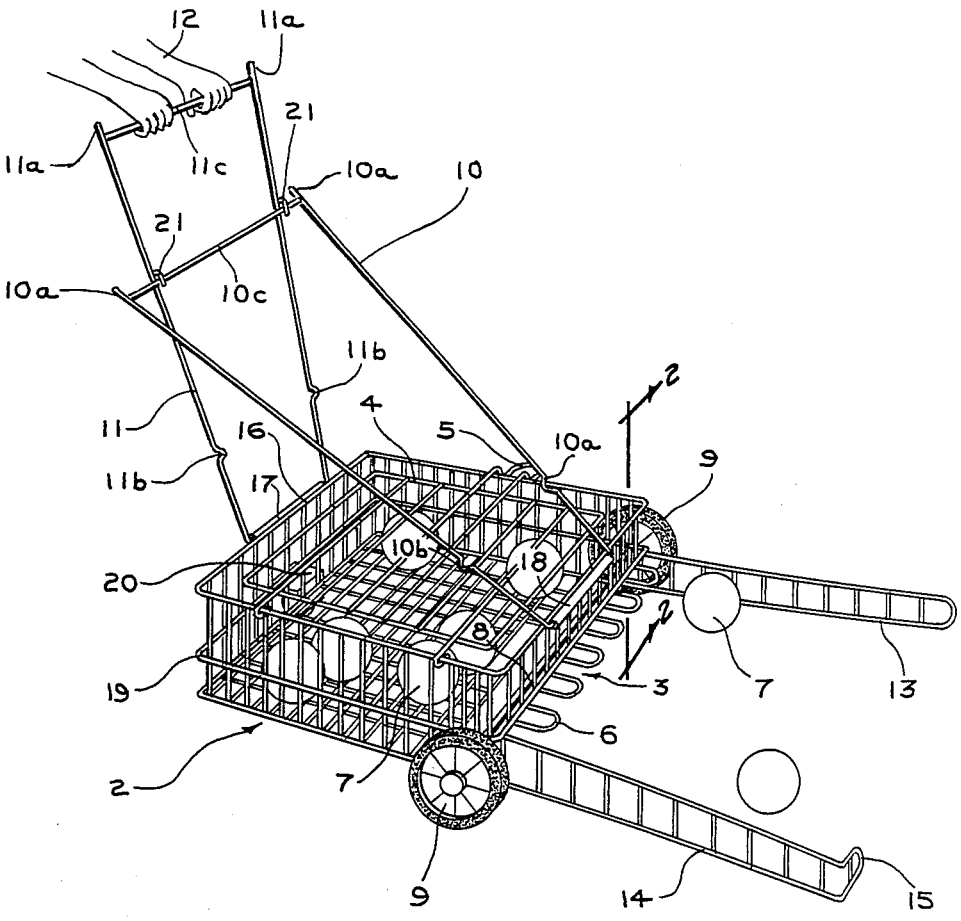
FIG. 1 shows a perspective view of an embodiment of a practice aid.

FIG. 1 shows a perspective view of the preferred embodiment of a practice aid in the ball collection mode. The container 2 or wire mesh ball cage retains balls in the interior. The container has and entry port 3 close to the ground and a dispensing port covered by hinged cover 4. Latch 5 allows easy opening and closing of cover 4 hinged at the side distal from the latch. Protrusions 6 help to capture the balls 7 and propel them against the shaft 8 as the device moves forward. Shaft 8 is rotatable by traction wheels 9 and, when in contact with balls 7, force the balls into the container through entry port 3. The protrusions or eyebrows 6 are placed at a height above the tennis court surface or ground approximately equal to or slightly less than the diameter of the tennis balls to be collected, approximately 6.4 cm (2.5 inches).

Front handle 10 is pivotally attached to the front of the container and, in this configuration, is also attached to the rear handle 11. The cross-bar **10*c* of front handle attaches to mating latches 21 on rear handle 11. The rear handle is pivotally attached to the rear of container 2. A player 12 pushes the device forward collecting balls 7 in the container 2. In the embodiment shown, the rear portion of the container 2 is lifted or dragged by player 12 using handles 10 and 11 to collect tennis balls. First arm 13 and second arm 14 project from the side front edges of the device to sweep a wider area and to guide balls 7 into contact with projections 6 and rotating shaft 8. The right arm 14 has a bend 15** forming a smooth rounded tip at the extreme end to avoid getting caught in nets or fences around the tennis court or other game playing area. Alternate configurations could employ bends in both arms for areas with many obstructions to get caught on, both arms without bends in areas relatively free of obstructions, and a device without arms for tight areas.

The rear handle 11 is pivotally attached to the upper rear portion 16 of container 2 by hinge 17. The top cross-bar **11*c* of handle 11 provides a convenient hand hold at a height which avoids stooping by the player to push the practice aid device along the tennis court. Front handle 10 is pivotally attached to the front portion 18 of container 2 and removably latched to rear handle 11. A single set 21 of attaching latches on back handle 11 is shown, but several points of attachment as an alternate would allow adjustable height of hand hold 11*c*. A swivel wheel assembly 20 is attached to the rear wall of container 2 in this embodiment to allow support of the rear section of the container and convenient changes in direction while collecting balls. The traction wheels 9 are mounted near the front portion of container 2 proximate the entry port 3 and support the major portion of the weight of the container in the ball collecting mode. Collection arms 13 and 14 sweep the area in front of the device for balls. Projections 6 pinch the balls to prevent their bouncing off the rotating shaft 8. The rotating shaft of traction wheels 9 is at a height which slightly compresses the balls and propels them through the entry port (not shown in this figure for clarity) and into the container 2**.

Figure 2:
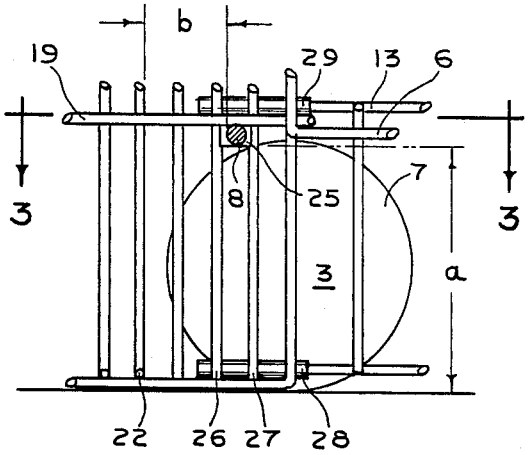
FIG. 2 is a partial cross-sectional view taken along line 2—2 of FIG. 1.
Figure 4:
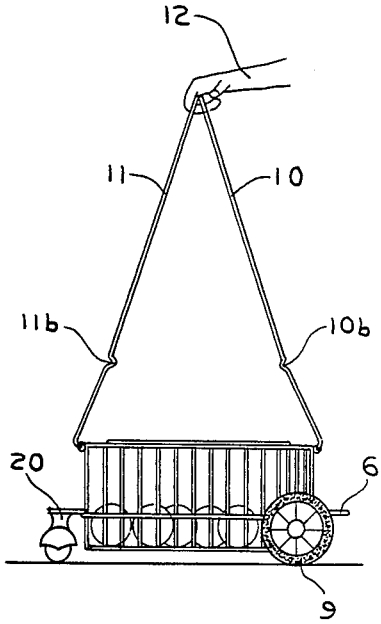
FIG. 4 shows a side view of the practice aid in the storage or carrying position.
Figure 3:
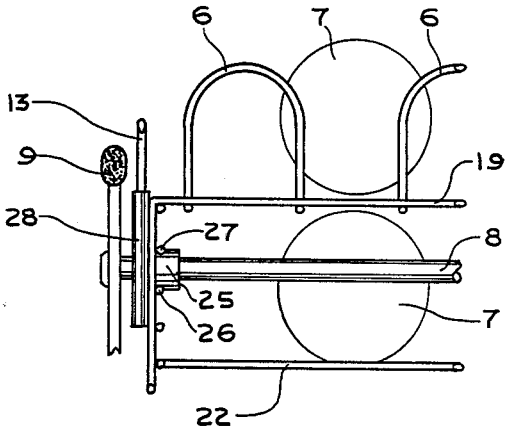
FIG. 3 is a partial top cross-sectional view taken along line 3—3 of FIG. 2.

If the two handles 10 and 11 are the similar (mirror image) in shape and dimensions, handles can also be joined at the top for lifting or carrying the practice aid to and from storage as illustrated in FIG. 4. As best illustrated in FIGS. 2 and 3, the entry port lower edge 22 is placed close to the ground over which balls are propelled by rotating shaft 8. Projections 6 help to direct the balls toward the rotating shaft 8. The gap between the arcuate projections is calculated to gently capture the top portion of the balls 7. Cover 4 is placed over the dispensing port 23 and is closed during the ball collection mode.

Figure 5:
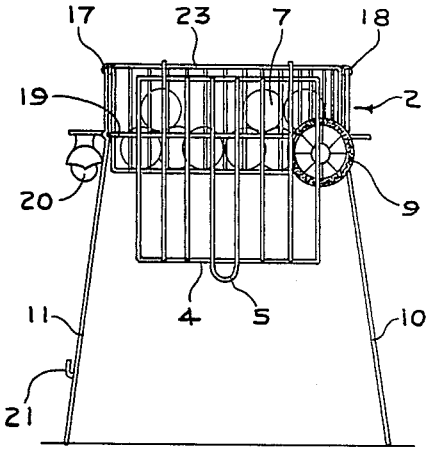
FIG. 5 shows a side view of the practice aid in the serving mode.

FIG. 5 shows a side view of the practice aid in the serving position. Front handle 10 is removed from handle latch 21 and rear handle rotated around hinge 17 to the downward position shown. Front handle 10 is also rotated to the downward position. The handles 10 and 11 become supporting legs for an elevated container 2. If the enbodiment shown in FIG. 1 is considered, ground contact contact is made by handle projections **10*a* and 11*a* giving a four point support rather than 2 line contact support and keeping gripping surface 11*c* of handles clear of the ground. Half loops 10*b* and 11*b* respectively formed in the sections of the handles 10 and 11 proximate the container are sized and located to resiliently engage the peripheral bar 19 which surrounds the container 2 at about mid-height. This engagement removably immobilizes the handles in the pedestal (serving) mode. Cover 4 is now unlatched to expose the dispensing port 23, which is large enough to allow manual removal of several balls or cans of balls from within the container 2. Traction wheels 9 and swivel wheel assembly 20, if present, are now raised off the ground since the aid, now functioning as a ball dispenser, is supported by handles 10 and 11. The handle length which made pushing the device convenient now also serves to elevate the container to a convenient dispensing height. Optional sweeping arms 13 and 14 no longer are functional and have been removed in this configuration, but if not in the way, can be left on the practice aid. Another configuration option, is to have the arms mounted to allow folding out of the way when not in use in the ball configuration mode. As shown in FIGS. 2 and 3, tubes 28 and 29 welded to the lower side walls of the container provides two pairs of sockets into which the end portions of the arms 13 and 14** can be removably plugged.

FIG. 4 shows a view of the practice aid in the storage mode. Handles 10 and 11 are brought together so that the device can be lifted or pulled along the ground on wheels 9 by player 12. grabbing both handles.

FIGS. 2 and 3 further show the relationship of the various elements about the entry port 3. Tennis ball 7 is about to contact rotating shaft 8 which is retained in bearings 25. The bearings are slidingly captured between vertical bars 26 and 27 at opposite sides of the entry port. When the container is lifted off the ground the shaft 8 slides down effectively closing the entry port and preventing the balls from rolling out of the container. Dimension "a", the height of the entry port must be somewhat less than the diameter of the balls being collected, but not excessively smaller which would preclude engagement of the rotating shaft to the ball. Experimentation has shown this dimension must be approximately 6.0 cm ($2\frac{3}{8}$ inches), but dimension can range from 5.4 to 6.4 cm ($2\frac{1}{8}$ to $2\frac{1}{2}$ inches) for a tennis ball diameter of 6.4 cm ($2\frac{1}{2}$ inches).

Dimension "b", the horizontal spacing between the shaft 8 and the bar 22 forming the lower edge of the entry port, is also important to the collection function. The position of edge 22 behind rotating shaft 8 must allow the shaft to contact and propel balls rearward, but and excessive gap will allow balls to collect at the entry port and minimize the storage ability of the container. If dimension "b" is excessive, the device will still function in the ball collection mode, but added effort to force balls at the entry port into the container will be required, and balls may escape from the entry port during the dispensing mode unless this port is otherwise blocked. Experimentation has shown optimum dimension "b" of approximately 3.2 cm ($1\frac{1}{4}$ inches). This results in a dimension between rotating shaft 8 and first edge 22 of approximately 6 cm ($2\frac{3}{8}$ inches). This prevents the balls from leaving the entry port unless compressed, but is large enough to allow entry of the ball propelled by the rotating shaft.

While the preferred embodiment of the invention has been shown and described, changes and modifications may be made therein within the scope of the appended claims without departing from the spirit and scope of this invention.

What is claimed is:

1. A game practice aid device for multiple use by a game player in combination with generally spherical deformable game balls, capable of the following modes of operation: collecting balls from a ground surface; storing balls; and dispensing balls, said device comprising:

a box-like container for retaining and storage of said balls;

a generally cylindrical rotatable shaft supporting said container, and positioned parallel to said ground in said ball collection mode;

roller means mounted at opposite ends of said shaft;

a generally rectangular ball entry port in said container having a first edge parallel to and proximate said ground surface in said ball collection mode, a pair of opposite side edges generally perpendicular to said first edge, and a top edge proximate and parallel to said rotatable shaft, wherein the dimension from said shaft to said ground is generally equal to or less than the diameter of said balls, said shaft being dimensioned and located to compress and rotate said balls into said container when in moving contact with said balls in said ball collecting mode;

a ball dispensing port in said container having an opening shaped and dimensioned to allow insertion of said player's hand and manual removal of said game balls; and at least two handles pivotally attached to opposite sides of said container and removably attached to each other during said ball collection mode, said handles shaped and dimensioned to support said container in an elevated position off said ground surface during said ball dispensing mode.

2. The device claimed in claim 1 which also comprises:

a cover removably attached to said ball dispensing port;

a rear suspension means attached to said container distal from said entry port and proximate to said ground surface in the ball collection mode, said suspension means allowing transverse rolling movement along the ground in any direction;

a plurality of forward projections extending from said top edge in a plane parallel to the ground when in the ball collection mode; and a first arm forwardly extending from one of said side edges said arm being shaped and dimensioned to sweep said balls towards said entry port and rotating shaft as the device is rolled on the ground in said ball collecting mode.

3. The device as claimed in claim 2 wherein said rear suspension means consists of a wheel, axle, and swiveling axle support structure assembly supporting said container in the ball collecting mode.

4. The device as claimed in claim 3 wherein said handles when in the dispensing mode contact the ground at positions which result in a stable support of said container elevated from said ground surface.

5. The device as claimed in claim 4 wherein said container is made from a wire grid.

6. The device as claimed in claim 5 wherein said roller means consists of a pair of traction wheels each one proximate to said one of said side edges, and said rotatable shaft is supported by bearings attached to said container.

7. The device as claimed in claim 6 wherein said rotatable shaft is knurled to increase friction at the interface between said ball and said shaft.

8. The device as claimed in claim 2 wherein said rear suspension means consists of a rear caster supporting a portion of said container opposite said entry port.

9. The device claimed in claim 2 which further comprises a second arm forwardly extending from the other side edge, said arm having its distal end arcuately bent.

10. A game practice aid device for use by a game player in combination with generally spherical deformable game balls, capable of collecting balls from a ground surface, said device comprising:

a container for retaining and storage of said balls having at least one port;

roller means and generally cylindrical rotatable shaft attached to and supporting said container, having said rotatable shaft located parallel to said ground surface;

a generally rectangular ball entry port in said container having a first edge parallel to and proximate said ground surface, a pair of side edges generally perpendicular to said first edge, and a final edge formed by said rotatable shaft, where the dimension from said shaft to said ground is nearly equal to the diameter of said balls, said shaft shaped and dimensioned to compress and rotate said balls to the interior of said container when in moving contact with said balls, and at least one handle attached to said container which allows said player to manually move said device.

* * * * *